US011363384B2

(12) United States Patent
Dang et al.

(10) Patent No.: US 11,363,384 B2
(45) Date of Patent: Jun. 14, 2022

(54) SENSITIVE DIAPHRAGM WITH RIM STRUCTURE AND SENSOR

(71) Applicant: Goertek, Inc., Weifang (CN)

(72) Inventors: Maoqiang Dang, Weifang (CN); Guanxun Qiu, Weifang (CN); Mengjin Cai, Weifang (CN)

(73) Assignee: Weifang Goertek Microelectronics Co., Ltd., Weifang (CN)

( * ) Notice: Subject to any disclaimer, the term of this patent is extended or adjusted under 35 U.S.C. 154(b) by 0 days.

(21) Appl. No.: 16/760,816

(22) PCT Filed: Sep. 6, 2018

(86) PCT No.: PCT/CN2018/104435

§ 371 (c)(1),
(2) Date: Apr. 30, 2020

(87) PCT Pub. No.: WO2020/000646

PCT Pub. Date: Jan. 2, 2020

(65) Prior Publication Data

US 2021/0185447 A1 Jun. 17, 2021

(30) Foreign Application Priority Data

Jun. 28, 2018 (CN) ..... 201810689186.4

(51) Int. Cl.
*H04R 7/06* (2006.01)

(52) U.S. Cl.
CPC ..... *H04R 7/06* (2013.01); *H04R 2201/003* (2013.01); *H04R 2207/021* (2013.01)

(58) Field of Classification Search
CPC ..... H04R 7/04; H04R 7/06; H04R 2207/00; H04R 2207/021
See application file for complete search history.

(56) References Cited

U.S. PATENT DOCUMENTS

2009/0151455 A1* 6/2009 Wu ..... G01L 9/0042 73/584
2015/0139477 A1* 5/2015 Tripp ..... H04R 7/16 381/398
2017/0013365 A1* 1/2017 Huang ..... H04R 9/06

FOREIGN PATENT DOCUMENTS

CN 102883248 1/2013
CN 202931541 5/2013
CN 204031450 12/2014
CN 204031450 U * 12/2014

OTHER PUBLICATIONS

English machine translation of CN 204031450 U (Menjin Cai, MEMS Microphone, published Dec. 2014) (Year: 2014).*

* cited by examiner

*Primary Examiner* — Mark Fischer
(74) *Attorney, Agent, or Firm* — Baker Botts LLP

(57) ABSTRACT

The present disclosure discloses a sensitive diaphragm comprising a diaphragm body, an edge region of the diaphragm body being provided with a rim structure, wherein the rim structure is in a non-closed annular shape, a non-closed region is located at a part not closed by the rim structure, and the non-closed region are integral and continuous with parts of the diaphragm body adjacent to the rim structure. According to the sensitive diaphragm of the present disclosure, the annular rim structure is separated by the non-closed region.

12 Claims, 4 Drawing Sheets

SENSITIVE DIAPHRAGM WITH RIM STRUCTURE AND SENSOR

CROSS-REFERENCE TO RELATED APPLICATIONS

This application is a National Stage of International Application No. PCT/CN2018/104435, filed on Sep. 6, 2018, which claims priority to Chinese Patent Application No. 201810689186.4, filed on Jun. 28, 2018, both of which are hereby incorporated by reference in their entireties.

TECHNICAL FIELD

The present disclosure relates to a sensitive diaphragm, and more particularly, to a sensitive diaphragm for a sensor, for example, a sensitive diaphragm applied to a microphone, a speaker, a pressure sensor, or the like.

BACKGROUND

With the development of technology, sensors have become indispensable components in electronic products, such as microphones used for picking up sound, speakers used for making sound, or pressure sensors used for measuring pressure.

These sensors basically utilize a deformation of a sensitive diaphragm to acquire detected information. For example, a microphone structure comprises a sensitive diaphragm and a backplate plate which form a plate capacitor structure. When the sensitive diaphragm senses a sound coming from an ambient environment, a deformation occurs to change a distance between the sensitive diaphragm and the backplate plate, thereby causing the plate capacitor structure to output a varying electrical signal with which the sound information is represented.

Generally, in order to increase the deformation amplitude of the sensitive diaphragm, an annular rim structure, that is a corrugated structure, is provided at an edge of the sensitive diaphragm. The rim structure can increase the deformation amplitude of a central region of the sensitive diaphragm and the detection effect is improved. However, when the sensitive diaphragm is subjected to a relatively strong impact, the rim structure may cause an excessive deformation of the central region of the sensitive diaphragm, which may lead to a failure in the sensitive diaphragm.

SUMMARY

An object of the present disclosure is to provide a novel technical solution of a sensitive diaphragm.

According to a first aspect of the present disclosure, there is provided a sensitive diaphragm comprising a diaphragm body, an edge region of the diaphragm body being provided with a rim structure, wherein the rim structure is in a non-closed annular shape, a non-closed region is located at a part not closed by the rim structure 4, and the non-closed region are integral and continuous with parts of the diaphragm body adjacent to the rim structure.

Optionally, the non-closed region comprises one non-closed region, the annular rim structure being interrupted by the one non-closed region.

Optionally, the non-closed region comprises at least two non closed regions, the annular rim structure being separated into at least two sections by the at least two non-closed regions.

Optionally, at least two of the non-closed regions have unequal lengths.

Optionally, at least two of the sections have unequal lengths.

Optionally, all the non-closed regions to the annular rim structure are equal in length and are uniformly distributed in a circumferential direction of the rim structure.

Optionally, the rim structure comprises a plurality of rim structures, the plurality of rim structures being sequentially distributed in a radial direction of the diaphragm body.

Optionally, the plurality of rim structures is identical in shape and arranged concentrically.

According to another aspect of the present disclosure, there is further provided a sensor comprising the above-mentioned sensitive diaphragm.

Optionally, the sensor is a pressure sensor, a microphone or a speaker.

According to the sensitive diaphragm of the present disclosure, the annular rim structure is separated by the non-closed region. When the sensitive diaphragm is subjected to a relatively strong impact, the non-closed region resists a deformation of the diaphragm body as compared to the rim structure due to the fact that the non-closed region is integral and continuous with the diaphragm body, thereby reducing the amplitude of the sensitive diaphragm and a risk of failure in the sensitive diaphragm.

Further features of the present disclosure and advantages thereof will become apparent from the following detailed description of exemplary embodiments according to the present disclosure with reference to the attached drawings.

BRIEF DESCRIPTION OF THE DRAWINGS

The accompanying drawings, which are incorporated in and constitute a part of the description, illustrate embodiments of the present disclosure and, together with the description thereof, serve to explain the principles of the present disclosure.

DETAILED DESCRIPTION

Figure 1:
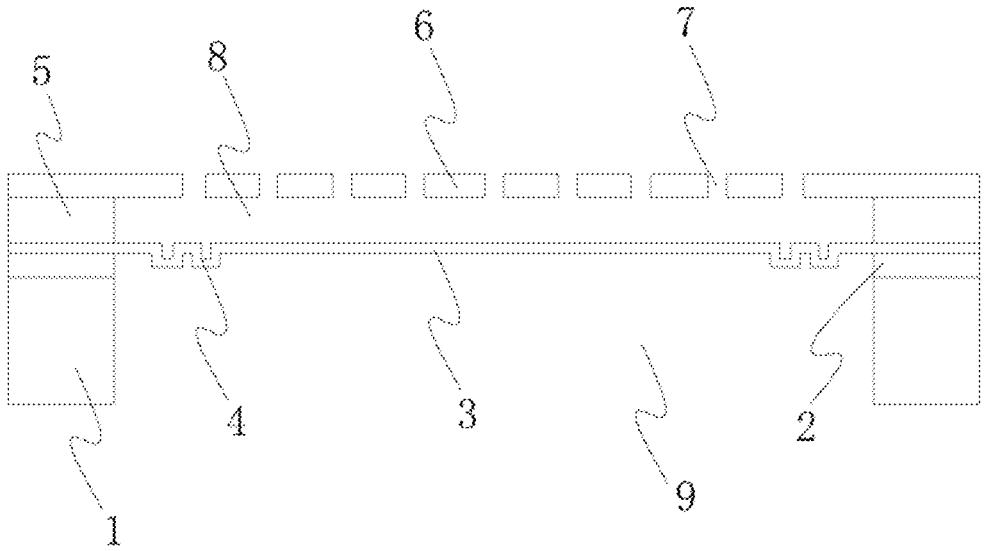
FIG. 1 is a schematic structural view of a microphone of the present disclosure.

Various exemplary embodiments of the present disclosure will now he explained in detail with reference to the drawings. It should be noted that the relative arrangement of the components and steps, the numerical expressions, and numerical values set forth in these embodiments do not limit the scope of the present disclosure unless it is specifically stated otherwise.

The following description of at least one exemplary embodiment is merely illustrative in nature and is in no way intended to limit the disclosure, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

The present disclosure provides a sensitive diaphragm which can be applied to devices comprising, but not limited to, a microphone, a speaker, a sensor such as a pressure sensor, and the like. The sensitive diaphragm, as an important component for these sensors, can sense interested information so as to output a corresponding electrical signal. Sensing principles and sensor structures belong to the common general knowledge of those skilled in the art and will not be specifically explained herein.

For the sake of clarity, the sensitive diaphragm according to the present disclosure will be explained in detail by taking an MEMS microphone as an example.

The MEMS microphone disclosed in the present disclosure comprises a substrate 1, a backplate 6 and a vibration diaphragm 3 which are located on the substrate 1. The backplate 6 and the vibration diaphragm 3 constitute a plate capacitor structure with a gap formed therebetween. The backplate 6 may be located above or below the vibration diaphragm 3.

FIG. 1 shows a plate capacitor structure in which the vibration diaphragm 3 is on a lower side and the bookplate 6 is on an upper side. Specifically, an edge of the vibration diaphragm 3 is bonded to the substrate 1, such that the vibration diaphragm 3 is suspended above a back cavity 9 of the substrate 1 except for the edge. The substrate 1 may be made of monocrystalline silicon or a material well known to those skilled in the art. In order to ensure the vibration diaphragm 3 and the substrate 1 are insulated, an insulating layer 2 is further formed between the vibration diaphragm 3 and the substrate 1. The backplate 6 can be supported above the vibration diaphragm 3 by a support portion 5, and the support portion 5 can ensure the gap 8 between the backplate 6 and the vibration diaphragm 3, to form the plate capacitor structure. In order to balance pressure between the backplate 6 and the vibration diaphragm 3, a plurality of through holes 7 are provided in the backplate 6. This configuration is the common general knowledge of those skilled in the art and will not be specifically explained herein.

The sensitive diaphragm 3 comprises a diaphragm body, and a rim structure 4 is provided at an edge region of the diaphragm body. A part of the diaphragm body located outside the rim structure 4 is used for connecting the substrate 1. A part of the diaphragm body located inside the rim structure 4 mainly functions to cooperate with the backplate 6 to output the varying electrical signal. The rim structure 4 can not only reduce stress in the diaphragm, but also increase the amplitude of the sensitive diaphragm 3, so as to improve the detection sensitivity of the plate capacitor.

Figure 5:
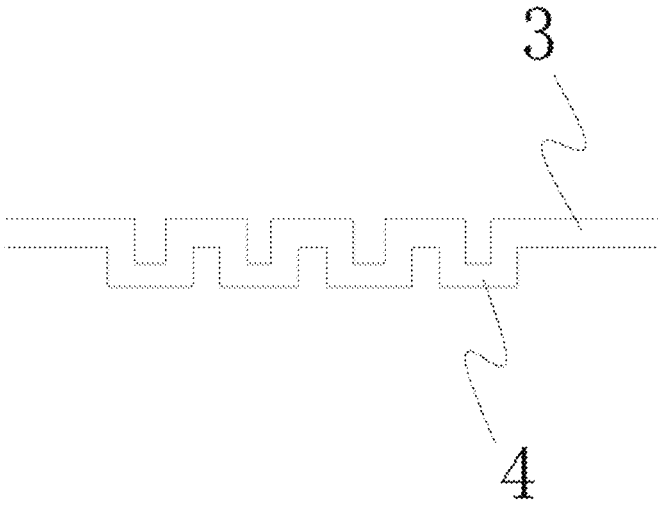
FIG. 5 is a schematic view of a cross section of the rim structure of the present disclosure.
Figure 6:
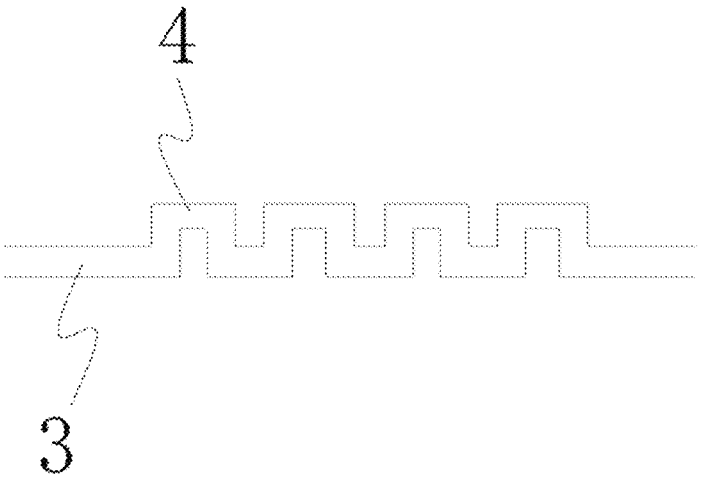
FIG. 6 is a schematic view of another embodiment of a cross section of the rim structure of the present disclosure.

A cross section of the rim structure 4 may be serrated. FIG. 5 shows a serrated rim structure 4 which is convex downwardly relative to the diaphragm body. FIG. 6 shows a serrated rim structure 4 which is convex upwardly relative to the diaphragm body. Of course, for those skilled in the art, the cross section of the rim structure 4 may also be V-shaped or other shapes well known to those skilled in the art, which will not be specifically explained herein.

According to the sensitive diaphragm of the present disclosure, the rim structure 4 is annular and non-closed. The rim structure 4 has a shape matched with that of the sensitive diaphragm 3. For example, when the sensitive diaphragm is circular, the rim structure 4 is annular. When the sensitive diaphragm is square or elliptical, the rim structure 4 has a shape corresponding thereto, which will not be specifically explained herein.

Figure 2:
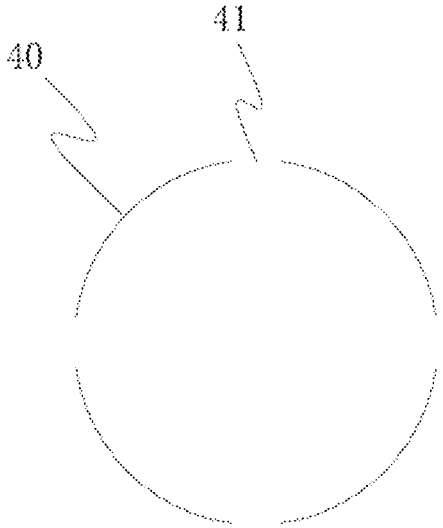
FIG. 2 is a schematic structural view of a first embodiment of a rim structure of the present disclosure.
Figure 3:
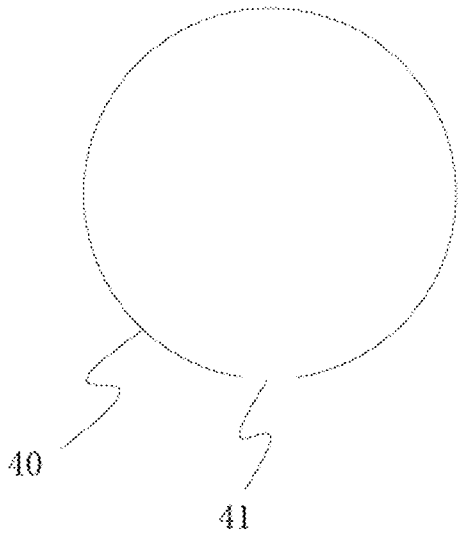
FIG. 3 is a schematic structural view of a second embodiment of the rim structure of the present disclosure.

Referring to FIG. 2 and FIG. 3, a non-closed region 41 is located at a part not closed by the rim structure 4, and the non-closed region 41 is integral and continuous with parts of the diaphragm body adjacent to the rim structure 4. The sensitive diaphragm is integrally formed by depositing and patterning during, manufacturing, and the diaphragm body is continuous in the same plane except for a position corresponding to the rim structure 4. The non-closed region 41 is located in an annular path of the rim structure 4, such that the rim structure 4 is interrupted.

The annular rim structure 4 is interrupted by the non-closed region 41. When the sensitive diaphragm is subjected to a relatively large impact, since the non-closed region 41 is integral and continuous with the diaphragm body, the non-closed region 41 will resist a deformation of the diaphragm body as compared to the rim structure 4, thereby reducing the amplitude of the sensitive diaphragm 3 and a risk of failure in the sensitive diaphragm 3.

In a specific embodiment of the present disclosure, the non-closed region 41 comprises one non-closed region, with reference to FIG. 3. The annular rim structure 4 is separated into a section 40 by the one non-closed region 41.

In another specific embodiment of the present disclosure, the non-closed region 41 comprises at least two non-closed regions, and the annular rim structure 4 is separated into at least two sections 40 by the at least two non-closed regions 41, with reference to FIG. 2.

Figure 4:
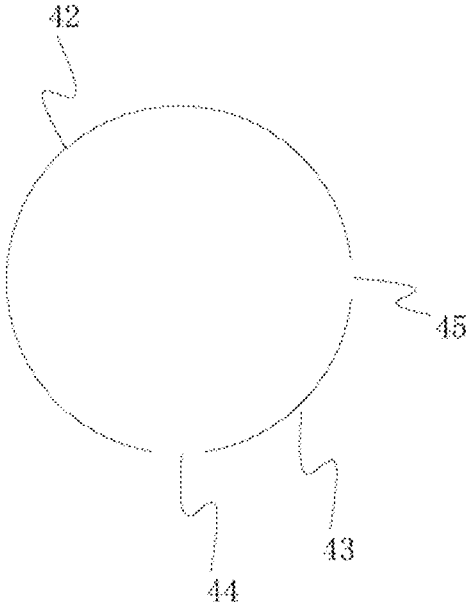
FIG. 4 is a schematic structural view of a third embodiment of the rim structure of the present disclosure.

Referring to FIG. 4, the non-closed region comprises two non-closed regions, the two non-closed regions respectively being referred to as a first non-closed region 44 and a second non-closed region 45. The first non-closed region 44 and the second non-closed region 45 separate the rim structure 4 into a first section 42 and a second section 43. The lengths of the first non-closed region 44 and the second non-closed region 45 may be designed to be unequal, or/and the lengths of the first section 42 and the second section 43 may be designed to be unequal according to actual needs. For those skilled in the art, a plurality of non-closed regions and sections may be provided, which is not limited herein.

For example, in a specific embodiment of the present disclosure, the sensitive diaphragm 3 may have a problem of polarization in some application environments. By selecting the lengths of part of the non-closed regions 44 to be unequal, and the lengths of part of the sections to be unequal, the problem of polarization can be inhibited and the smooth operation of the sensitive diaphragm is ensured.

Optionally, at least two of the sections of the rim structure 4 have different cross sections, and the cross sections of the sections are selected from one of an upper convex serrated shape, a lower convex serrated shape or a V shape. For example, referring to FIG. 4, the cross section of the first section 42 may be V-shaped, and the cross section of the second section 43 may be serrated. By designing the sections of different cross sections in the same rim structure 4, the deformation capabilities of different sections are different, so that the deformation degree of the sensitive diaphragm can be restricted.

A plurality of, at least four, non-closed regions 41 and sections 40 are preferably provided. Referring to FIG. 2, four non-closed regions 41 are provided, and separate the annular rim structure 4 into four sections 40. All the non-closed regions 41 are equal in length and evenly distributed in the circumferential direction of the rim structure 4, such that the lengths of all sections 40 are equal. Due to the design of such a symmetrical structure, the vibration of the sensitive diaphragm 3 can be balanced.

In FIG. 2, the cross sections of the four sections 40 may be the same or different. Preferably, the two sections which are symmetrically distributed have the same cross section, and the two adjacent sections have different cross sections.

A plurality of rim structures 4 according to the present disclosure may be provided, and the plurality of rim structures 4 is sequentially distributed in the radial direction of the diaphragm body. By the plurality of rim structures, the in-diaphragm stress is adjusted, and the amplitude of the diaphragm body is increased. Preferably, the cross sections of two adjacent rim structures may be different. For example, when two rim structures are provided, the cross section of one of the rim structures may be selected to be V-shaped, and the cross section of the other rim structure may be selected to be serrated. When the vibration diaphragm is subjected to an external force, the plurality of rim structures with different cross sections can be mutually restricted to ensure the stability performance of the sensitive diaphragm.

Figure 7:
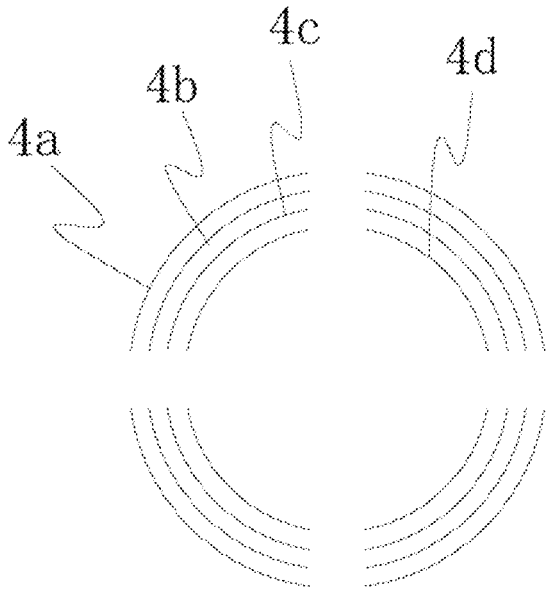
FIG. 7 is a schematic structural view of a fourth embodiment of the rim structure of the present disclosure.

The number of the rim structures 4 is preferably set to be plural, for example, two, four, six or more. Referring to FIG. 7, four rim structures are provided, and are respectively referred to as a first rim structure 4*a*, a second rim structure 4*b*, a third rim structure 4*c*, and a fourth rim structure 4*d*. The four rim structures are circular in shape, are arranged concentrically and are sequentially distributed in the radial direction of the diaphragm body.

The cross sections of the four rim structures may be the same or different. In a specific embodiment of the present disclosure, the first rim structure 4*a* and the second rim structure 4*b* adjacent to each other have different cross sections. The second rim structure 4*b* and the third rim structure 4*c* adjacent to each other have different cross sections. The third rim structure 4*c* and the fourth rim structure 4*d* adjacent to each other have different cross sections Alternatively, the two rim structures separated by one of the rim structures have the same cross section. That is, the first rim structure 4*a* and the third rim structure 4*c* which are separated by the second rim structure 4*b* have the same cross section. The second rim structure 4*b* and the fourth rim structure 4*d* which are separated by the third rim structure 4*c* have the same cross section. The rim structures of the same cross section are separated by the rim structures of different cross sections, such that the rim structures are mutually restricted.

In an optional embodiment of the present disclosure, the non-closed regions of different rim structures correspond with each other. Referring to FIG. 7, all the non-closed regions of the first rim structure 4*a*, the second rim structure 4*b*, the third rim structure 4*c*, and the fourth rim structure 4*d* correspond with each other.

Figure 8:
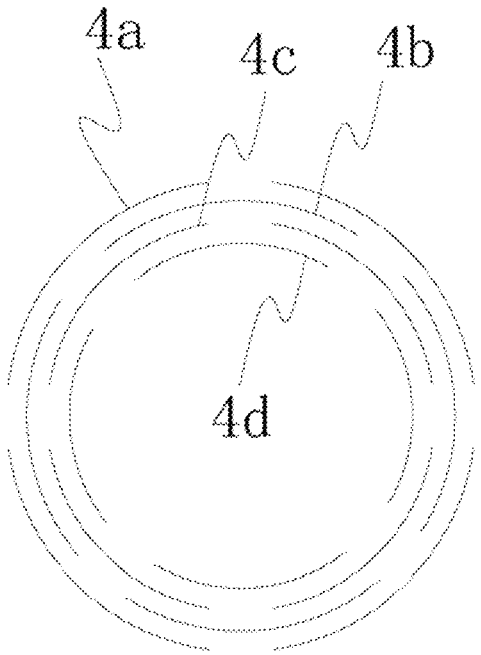
FIG. 8 is a schematic structural view of a fifth embodiment of the rim structure of the present disclosure.

In an optional embodiment of the present disclosure, the non-closed regions of different rim structures are staggered from one another. Referring to FIG. 8, the non-closed regions in the first rim structure 4*a*, the second rim structure 4*b*, the third rim structure 4*c*, and the fourth rim structure 4*d* are staggered from each other.

Preferably, the non-closed regions of the rim structures have the same cross section corresponding with each other. For example, when the first rim structure 4*a* and the third rim structure 4*c* have the same cross section, and the second rim structure 4*b* and the fourth rim structure 4*d* have the same cross sections, the non-closed regions of the first rim structure 4*a* and the third rim structure 4*c* correspond with each other, and the non-closed regions of the second rim structure 4*b* and the fourth rim structure 4*d* correspond with each other. The non-closed regions of the first rim structure 4*a* and the third rim structure 4*c* and the non-closed regions of the second rim structure 4*b* and the fourth rim structure 4*d* are staggered from each other by a certain angle.

According to the sensitive diaphragm of the present disclosure, the number, length and position of the non-closed regions and the sections, the cross section area of the sections, the number of the rim structures and the like can be adjusted separately or comprehensively as needed, so as to meet the requirements of respective tools on the sensitive diaphragm, which are not listed here one by one.

Although some specific embodiments of the present disclosure have been demonstrated in detail with examples, it should be understood by a person skilled in the art that the above examples are only intended to be illustrative but not to limit the scope of the present disclosure. It should be understood by those skilled in the art that the above embodiments could be modified without departing from the scope and spirit of the present disclosure. The scope of the present disclosure is defined by the appended claims

The invention claimed is:

1. A sensitive diaphragm comprising:

a diaphragm body, an edge region of the diaphragm body being provided with a rim structure having a non-closed annular shape, and a non-closed region provided at a portion thereof that is not closed by the rim structure, wherein the non-closed region is integral and continuous with a portion of the diaphragm body adjacent to the rim structure, wherein the non-closed region comprises at least two non-closed regions, wherein the annular rim structure is separated into at least two sections by the at least two non-closed regions, wherein at least two of the at least two sections of the rim structure have different cross sections, wherein a first part of the diaphragm body located outside the rim structure is used for connecting a substrate, and a second part of the diaphragm body located inside the rim structure is used to cooperate with a backplate to output the varying electrical signal, and wherein the diaphragm body is continuous in the same plane except for a position of the rim structure.

2. The sensitive diaphragm according to claim 1, wherein a cross section of a first of the at least two sections is V shaped, and a cross section of a second section of the at least two sections is serrated.

3. The sensitive diaphragm according to claim 1, wherein at least two of the non-closed regions have unequal lengths.

4. The sensitive diaphragm according to claim 1, wherein at least two of the sections have unequal lengths.

5. The sensitive diaphragm according to claim 1, wherein all the non-closed regions to the annular rim structure are equal in length and are uniformly distributed in a circumferential direction of the rim structure.

6. The sensitive diaphragm according to claim 1, wherein the rim structure comprises a plurality of rim structures, the plurality of rim structures being sequentially distributed in a radial direction of the diaphragm body, wherein two adjacent rim structures are connected with each other in the radial direction through the diaphragm body.

7. The sensitive diaphragm according to claim 6, wherein the plurality of rim structures are arranged concentrically.

8. The sensitive diaphragm according to claim 6, wherein the non-closed regions of the rim structures having the same cross section correspond with each other.

9. The sensitive diaphragm according to claim 6, wherein the non-closed regions of the rim structures having a different cross section are staggered from each other by a certain angle.

10. The sensitive diaphragm according to claim 6, the non-closed regions of different rim structures are staggered from one another.

11. A sensor comprising the sensitive diaphragm according to claim 1.

12. The sensor according to claim 11, wherein the sensor is a pressure sensor, a microphone or a speaker.

* * * * *